US008721225B2

(12) United States Patent
Haugsøen et al.

(10) Patent No.: US 8,721,225 B2
(45) Date of Patent: May 13, 2014

(54) METHOD AND DEVICE FOR CONTROLLING TRANSMISSION OF FORCE BETWEEN A STRUCTURE AND ITS BASE DURING INSTALLATION

(75) Inventors: Per Bull Haugsøen, Bergen (NO); Gunnar Foss, The Hague (NL)

(73) Assignee: OWEC Tower AS, Bergen (NO)

( * ) Notice: Subject to any disclaimer, the term of this patent is extended or adjusted under 35 U.S.C. 154(b) by 0 days.

(21) Appl. No.: 13/382,551

(22) PCT Filed: Jul. 20, 2010

(86) PCT No.: PCT/NO2010/000289

§ 371 (c)(1),
(2), (4) Date: Feb. 14, 2013

(87) PCT Pub. No.: WO2011/010937

PCT Pub. Date: Jan. 27, 2011

(65) Prior Publication Data

US 2013/0149039 A1 Jun. 13, 2013

(30) Foreign Application Priority Data

Jul. 22, 2009 (NO) ..... 20092746

(51) Int. Cl.
*E02D 27/52* (2006.01)

(52) U.S. Cl.
USPC ..... 405/225; 405/222

(58) Field of Classification Search
USPC ..... 405/222, 223, 224, 225, 227, 232, 233, 405/244, 255–257
See application file for complete search history.

(56) References Cited

U.S. PATENT DOCUMENTS 4,311,414 A * 1/1982 Baldridge ..... 405/227
4,799,816 A * 1/1989 Lechon et al. ..... 403/2

FOREIGN PATENT DOCUMENTS

| | | |
|---|---|---|
| GB | 1485755 | 9/1977 |
| GB | 1593145 | 7/1981 |
| JP | 2002322654 | 9/2002 |
| WO | WO 9400643 | 1/1994 |

OTHER PUBLICATIONS

PCT Written Opinion, Oct. 21, 2010.
PCT Search Report, Oct. 21, 2010.

* cited by examiner

*Primary Examiner* — Tara M. Pinnock
(74) *Attorney, Agent, or Firm* — Patents + TMS, P.C.

(57) ABSTRACT

A method controls force transmission between a structure and its base during grouting-in the fastening parts of the structure in the corresponding bases on or in the seabed. The method may include connecting a bracket to at least one of the fastening parts of the structure; arranging an elastic material on the bracket; displacing the fastening part to an overlapping position with the base until the elastic material transmits at least a portion of the weight of the structure to the base; and filling an opening between the fastening part and the base with a curable mass.

8 Claims, 3 Drawing Sheets

II-II

METHOD AND DEVICE FOR CONTROLLING TRANSMISSION OF FORCE BETWEEN A STRUCTURE AND ITS BASE DURING INSTALLATION

CROSS REFERENCE TO RELATED APPLICATIONS

This application claims benefit of PCT Application Serial Number PCT/NO2010/000289 filed on Jul. 20, 2010, Norwegian Application Serial Number 20092746 filed on Jul. 22, 2009.

STATEMENT REGARDING FEDERALLY SPONSORED RESEARCH OR DEVELOPMENT

Not applicable

THE NAMES OF THE PARTIES TO A JOINT RESEARCH AGREEMENT

Not Applicable

INCORPORATION-BY-REFERENCE OF MATERIAL SUBMITTED ON A CD

Not applicable

BACKGROUND OF THE INVENTION (a) Field of the Invention

This invention relates to a method for controlling force transmission between a structure and its base during installation. More particularly it concerns a method for controlling force transmission between a structure and its base during grouting-in the fastening parts of the structure in corresponding bases on or in the seabed. The invention also includes a device for performing the method.

(b) Description of Related Art

During installation and fastening of structures offshore by means of concreting, there is a considerable problem in that the structure does not remain completely still during the curing process, the reason typically being wave and wind forces acting against the structure.

Structures of this kind often comprise a three- or four-legged truss structure where each leg comprises a fastening part at its lower portion. The fastening part is arranged to be able to be displaced into a base sunk in the seabed, typically in the form of a pipe. Three-legged structures stand relatively steady on their bases, while four-legged structures are difficult to keep still, as they have a tendency to rock about an axis between two of the bases.

To avoid displacements larger than three mm between the fastening parts and the bases during the curing process, it is necessary to carry out the grouting process in good weather.

BRIEF SUMMARY OF THE INVENTION

The object of the invention is to remedy or reduce at least one of the disadvantages of the prior art.

The object is achieved in accordance with the invention by the features disclosed in the following description and in the subsequent claims.

There is provided a method for controlling force transmission between a structure and its base during grouting-in the fastening parts of the structure in the corresponding bases on or in the seabed, and where the method is characterised by connecting a bracket to at least one of the fastening parts of the structure; arranging an elastic material on the bracket; displacing the fastening part to an overlapping position with the base until the elastic material transmits a least a portion of the weight of the structure to the base; and filling an opening between the fastening part and the base with a curable mass. By compression the elastic material will be able to compensate for different base heights, whereby a portion of the weight of the structure is applied to each base.

The method may further comprise: measuring the relative heights of the bases; and placing adapted distance pieces at the elastic material before the fastening parts are brought into overlapping position relative to the base.

By measuring the relative heights of the bases, distance pieces arranged over or under the elastic material may compensate for larger mutual deviations in the base heights.

The method may further comprise choosing load area, thickness and hardness of the elastic material relative to load such that further deformation of the elastic material mainly ceases when all the brackets bear their portion of the weight and load of the structure. The loading on each bracket may vary.

The method may be performed by means of a device for controlling the force transmission between a structure and its base during grouting-in of the fastening parts of the structure in corresponding bases on or in the seabed, where the device is characterised in that a bracket is connected to at least one of the fastening parts of the structure and where an elastic material is arranged on the side of the bracket facing the base, and where the elastic material is arranged to be able to transmit at least a portion of the weight of the structure to the base.

Adapted distance pieces may be arranged on at least the top or underside of the elastic material to compensate for different, relative base height.

A load distribution plate may be arranged between the elastic material and the base in order to distribute the load to the elastic material.

Preferably the bracket encircles the leg, as the elastic material in the form of a number of material pieces may be distributed around the leg.

The elastic material may have varying hardness in different positions relative to the bracket. Two diagonally opposing material pieces may for example have a hardness different from two other diagonally opposing material pieces.

Advantageously the bracket may be provided with apertures therethrough for concreting pipes and openings therethrough for a vibrator and inspection.

A method and a device in accordance with the invention renders stabilised positioning possible also of structures having four or more legs, as the elastic material at the two brackets first abutting their bases are compressed until the elastic material at the remainders of the brackets are taking their portion of the load.

BRIEF DESCRIPTION OF THE SEVERAL VIEWS OF THE DRAWINGS

In the following is described an example of e preferred method and embodiment illustrated in the accompanying drawings, wherein.

DETAILED DESCRIPTION OF THE INVENTION

Figure 1:
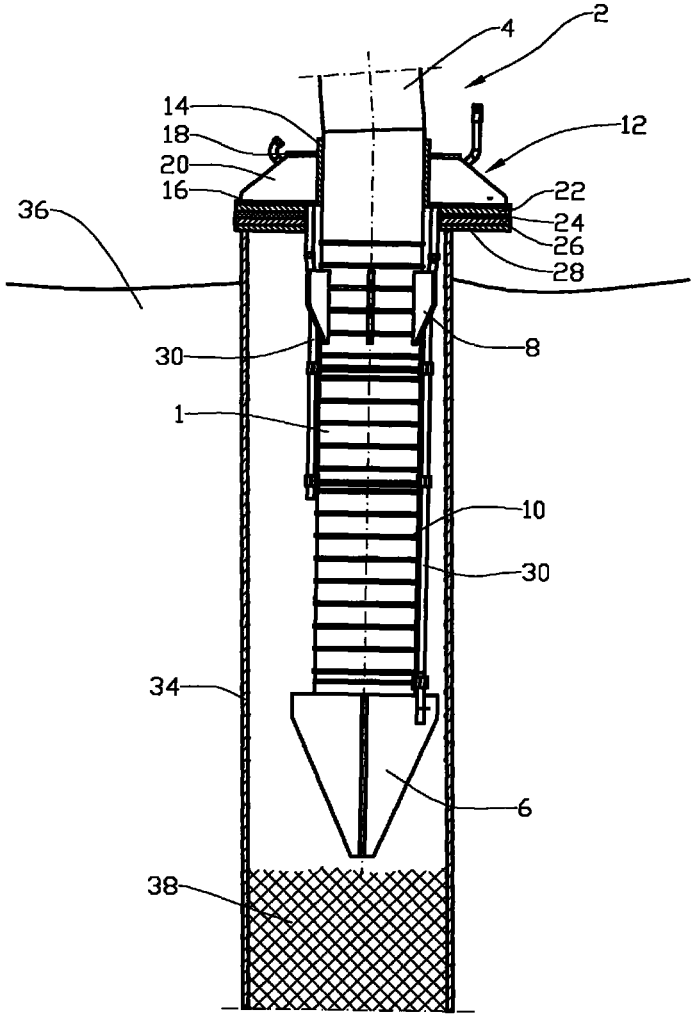
FIG. 1 shows a fastening part with a bracket comprising elastic material according to the invention where the fastening part is placed in a base.

In the drawings the reference numeral 1 indicates a fastening part constituting an extension of the leg 4 of a structure 2. The fastening part 1 comprises in a per se known way lower guide plates 6 and upper guide plates 8, and is designed with a number of encircling weld ridges 10 arranged to be able to improve the binding to a grouting mass.

A bracket 12, in this example being constituted by a welded plate structure, encircles the fastening part 1 near the leg 4. The bracket 12 is designed with a welded crown 14 fastened to the fastening part 1 by a welded connection.

An encircling load plate 16 is fastened to the lower end of the welded crown 14. A stiffener plate 18 encircles the welded crown 14 at a level above the load plate 16. A number of bracket plates 20, arranged between the load plate 16 and the stiffener plate 18, are distributed around the welded crown 14.

Corresponding to the position of each bracket plate 20 on the opposite down facing side of the load plate 16, is arranged a number of upper connection plates 22. The upper connection plates 22 are on their opposing side covered with an elastic material 24. The elastic material 24 is on its underside formed with a lower connection plate 26 and a distance piece 28. The lower connection plate 26 and the distance piece 28 may be constituted by the same piece of material.

The elastic material 24 may comprise an artificial material or natural rubber. It may also comprise combinations thereof.

The fastening part 1 further comprises grouting pipes 30 for supplying grouting material. The load plate 16 has openings 32 therethrough for inspection and insertion of a not shown vibrator.

In FIG. 1 is a base 34 in the form of a pipe displaced down into the seabed. The base 34 is filled with sand 38 up to a desired level.

The welded joint between the welded crown 14 and the fastening part 1 is designed such that the impulse force transmitted between the base 34 and the structure 2 is absorbed through this welded joint only. At the same time it is designed such that a bending moment in the leg 4 is only to an insignificant degree transmitted to the bracket 12.

Figure 2:
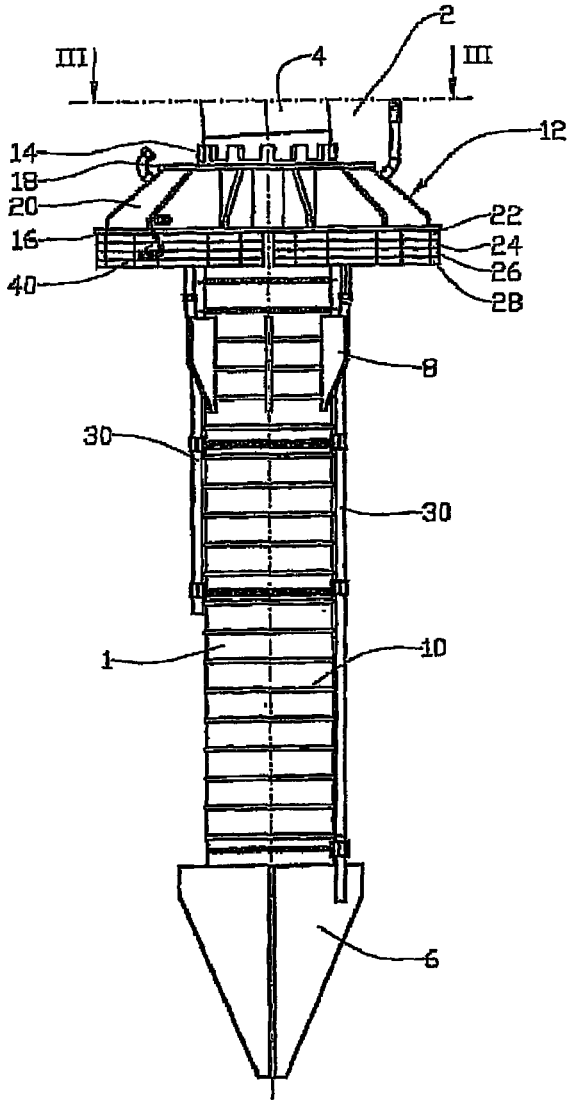
FIG. 2 shows a fastening part in a somewhat larger scale.
Figure 3:
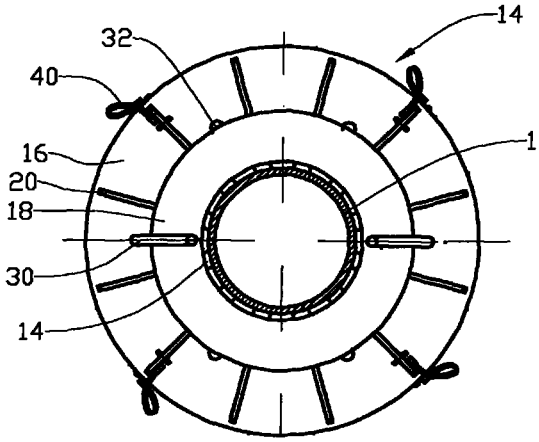
FIG. 3 shows a section in FIG. 2.
Figure 4:
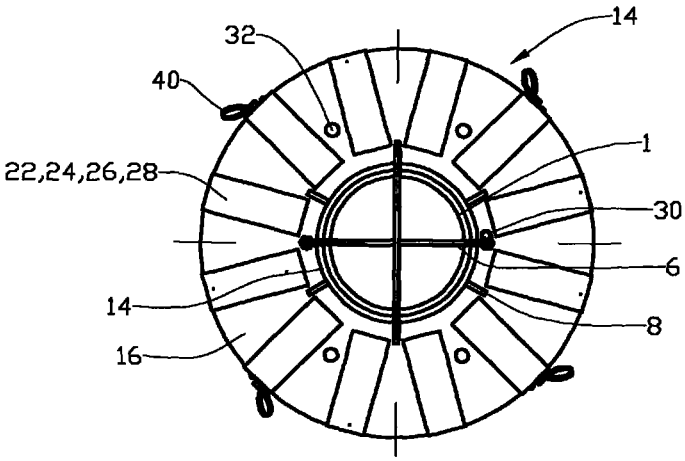
FIG. 4 shows an underside view of the fastening part.

A number of electric leads 40 are arranged between the brackets 12 and the lower connection plates 26 or distance pieces 28 to equalize electric potential between the structure 2 and the base 34. Only one of these electric leads 40 is shown in FIG. 2.

The fastening part 1 is led into the base 34 until the distance piece 28 via among other things the elastic material 24 has come into abutment against the base 34.

When a four-legged structure 2 is to be mounted on the seabed 36, a bracket 12 with appurtenant elastic material 24 is fastened to each of the fastening parts 1, as each of the fastening parts 1 form an extension to each of the legs 4 of the structure 2.

The mutual heights of the bases 34 are measured, whereafter distance pieces 28 are adapted and placed under the lower connection plate 26.

The structure 2 is lowered such that the four fastening parts 1 are led into each respective base 34 until the load from the structure is distributed on the bases 34. The possibility of the structure 2 to be able to rock is thereby considerably reduced.

Due to the elastic material 24 taking up deviations in the mutual heights of the bases 34, the load acting against each base 34 may be different. The elastic material also takes up shocks as the distance pieces 28 come into abutment against the base 34.

The elastic material 24 also equalizes misalignments between the base 34 and the bracket 12 as is shown in FIG. 1 where the elastic material 24 has different deformation on diametrically opposite sides of the fastening part 1.

Grouting is filled via the grouting pipes 30 in between the base 34 and the fastening part 1.

The invention claimed is:

1. A method for controlling force transmission between a structure and bases of the structure during grouting-in of fastening parts of the structure in the bases on or in a seabed, wherein each of the fastening parts has a corresponding base of the bases, the method comprising:

connecting a bracket to a first fastening part of the fastening parts;

arranging a load bearing, elastic material on the bracket;

displacing the first fastening part to an overlapping position with the corresponding base of the first fastening part until the load bearing, elastic material transmits at least a portion of the weight of the structure to the corresponding base of the first fastening part; and filling an opening between the first fastening part and the corresponding base of the first fastening part with a curable mass.

2. The method of claim 1, further comprising:

measuring relative heights of the bases; and placing adapted distance pieces at the load-bearing, elastic material before the fastening parts are brought into position relative to the bases.

3. The method of claim 1, further comprising:

choosing at least one of load area, thickness and hardness of the load-bearing elastic material in relation to applied load such that further deformation of the load-bearing, elastic material ceases when the bracket takes the applied load.

4. A device for controlling force transmission between a structure and bases of the structure during grouting-in of fastening parts of the structure in the bases on or in a seabed, the device comprising:

a bracket connected to the fastening part wherein the bracket has a side which faces the corresponding base of the fastening part; and a load bearing elastic material arranged on the side of the bracket facing the corresponding base of the fastening part wherein the load bearing elastic material is arranged to be able to transmit at least a portion of the weight of the structure to the corresponding base of the fastening part.

5. The device of claim 4, further comprising:

adapted distance pieces arranged on at least the top or the underside of the load bearing elastic material.

6. The device of claim 4, wherein the bracket encircles the fastening part.

7. The device of claim 4, wherein the load bearing elastic material has different hardness in different positions relative to the bracket.

8. The device of claim 4, wherein the bracket has apertures therethrough for grouting pipes.

* * * * *